US011401946B2

(12) United States Patent
Sun et al.

(10) Patent No.: US 11,401,946 B2
(45) Date of Patent: Aug. 2, 2022

(54) FAN FLOW GUIDE STRUCTURE

(71) Applicant: ASIA VITAL COMPONENTS CO., LTD., New Taipei (TW)

(72) Inventors: Sung-Wei Sun, New Taipei (TW); Ming-Che Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 17/142,241

(22) Filed: Jan. 6, 2021

(65) Prior Publication Data

US 2022/0213902 A1 Jul. 7, 2022

(51) Int. Cl.

| | |
|---|---|
| ***F04D 29/44*** | (2006.01) |
| ***F04D 29/28*** | (2006.01) |
| ***F04D 29/42*** | (2006.01) |

(52) U.S. Cl.

CPC ..... *F04D 29/441* (2013.01); *F04D 29/281* (2013.01); *F04D 29/4226* (2013.01)

(58) Field of Classification Search

CPC ... F04D 29/441; F04D 29/4226; F04D 29/424
See application file for complete search history.

(56) References Cited

U.S. PATENT DOCUMENTS

| | | | | |
|---|---|---|---|---|
| 8,684,661 | B2 * | 4/2014 | Horng | F04D 17/04 415/53.1 |
| 9,518,584 | B2 * | 12/2016 | Chen | F04D 25/0613 |
| 9,568,019 | B2 * | 2/2017 | Lu | F04D 29/626 |
| 2006/0024160 | A1 | 2/2006 | Horng et al. | |

FOREIGN PATENT DOCUMENTS

| | | | |
|---|---|---|---|
| CN | 201381995 | Y | 1/2010 |
| CN | 103727066 | A | 4/2014 |
| CN | 203770218 | U | 8/2014 |
| CN | 214036268 | U | 8/2021 |
| KR | 10-2008-0010012 | A | 1/2008 |
| TW | 201014980 | A | 4/2010 |
| TW | M611207 | | 5/2021 |

OTHER PUBLICATIONS

Search Report dated Jun. 1, 2020 issued by Taiwan Intellectual Property Office for counterpart application No. 109141395.
Search Report dated Apr. 27, 2022 issued by China National Intellectual Property Administration for counterpart application No. 109141395.

* cited by examiner

*Primary Examiner* — Sabbir Hasan
(74) *Attorney, Agent, or Firm* — Bradley J. Thorson; DeWitt LLP

(57) ABSTRACT

A fan flow guide structure includes a centrifugal fan impeller and a case. The case includes an upper cover and a base seat. A fan impeller space and a flow passage are defined between the upper cover and the base seat. The fan impeller space serves to receive the centrifugal fan impeller. The flow passage is in communication with the fan impeller space and a lateral wind outlet. A tongue section is disposed in the flow passage in adjacency to the lateral wind outlet. A wind supplementing section is defined opposite to the tongue section. An intake gill section is disposed on the upper cover and/or the base seat in communication with the wind supplementing section. Accordingly, the airflow outside the case can be guided from the intake gill section into the wind supplementing section to enhance the flow amount of the fan.

8 Claims, 9 Drawing Sheets

FAN FLOW GUIDE STRUCTURE

BACKGROUND OF THE INVENTION

1. Field of the Invention

The present invention relates generally to a fan flow guide structure, and more particularly to a fan flow guide structure applicable to a centrifugal fan.

2. Description of the Related Art

There is a trend toward designing electronic device or handheld device such as mobile phone or tablet with thinner and more advanced type. As a result, more electronic components are received in a narrower internal space of the device to generate more heat. In order to more effectively dissipate the heat in the handheld device, a centrifugal fan is disposed in the handheld device. As shown in FIGS. 6A and 6B, the conventional centrifugal fan 30 has an internal flow passage 31 in communication with a lateral wind outlet 32 and a fan impeller space 33. A centrifugal fan impeller 34 is disposed in the fan impeller space 33. A tongue section 35 is disposed on one side of the flow passage 31 in adjacency to the lateral wind outlet 32. When the fluid passes through the flow passage 31 to flow out from the lateral wind outlet 32, most of the fluid flows out from a section 37 opposite to the tongue section 35. Accordingly, the flow speed of the section 37 opposite to the tongue section 35 is faster and the pressure is lower. Due to the tongue section 35, the pressure and the flow speed of the fluid at the lateral wind outlet 32 are non-uniform. This will affect heat dissipation efficiency.

It is therefore tried by the applicant to provide a fan flow guide structure to solve the problem existing in the conventional centrifugal fan.

SUMMARY OF THE INVENTION

It is therefore a primary object of the present invention to provide a fan flow guide structure, which can enhance the fan flow amount in the same fan capacity.

It is a further object of the present invention to provide a fan flow guide structure, which can take external air into the wind supplementing section of the fan according to the direction of the airflow in the fan.

To achieve the above and other objects, the fan flow guide structure of the present invention includes a centrifugal fan impeller and a case. The case includes an upper cover and a base seat connected with the upper cover. A peripheral wall is formed between the upper cover and the base seat. A lateral wind outlet is formed on the periphery wall. A fan impeller space and a flow passage are defined between the upper cover and the base seat and the peripheral wall. The fan impeller space serves to receive the centrifugal fan impeller. The flow passage is in communication with the fan impeller space and the lateral wind outlet. A tongue section is disposed in the flow passage in adjacency to the lateral wind outlet. A wind supplementing section is defined opposite to the tongue section in adjacency to the lateral wind outlet. An upper intake gill section is disposed on the upper cover corresponding to the wind supplementing section in communication with the wind supplementing section.

In the above fan flow guide structure, the upper intake gill section includes at least one first guide vane and at least one first flow guide hole. The first guide vane obliquely extends from the upper cover to the wind supplementing section. The first guide vane has a first free end directed to the lateral wind outlet. The at least one first flow guide hole is formed on an upper surface of the first guide vane and directed to the lateral wind outlet. The first flow guide hole obliquely passes through the upper cover in communication with the wind supplementing section.

In the above fan flow guide structure, a lower intake gill section is disposed on the base seat corresponding to the wind supplementing section. The lower intake gill section is in communication with the wind supplementing section.

In the above fan flow guide structure, the lower intake gill section includes at least one second guide vane and at least one second flow guide hole. The second guide vane obliquely extends from the base seat to the wind supplementing section. The second guide vane has a second free end directed to the lateral wind outlet. The at least one second flow guide hole is formed on an upper surface of the second guide vanes and directed to the lateral wind outlet. The second flow guide hole obliquely passes through the base seat in communication with the wind supplementing section.

In the above fan flow guide structure, the lower intake gill section is opposite to the upper intake gill section of the upper cover.

In the above fan flow guide structure, the upper cover has an upper wind inlet and the base seat has a lower wind inlet. The upper wind inlet and the lower wind inlet are in communication with the fan impeller space.

In the above fan flow guide structure, the case has a lateral wind inlet in communication with the fan impeller space.

In the above fan flow guide structure, the tongue section protrudes from the peripheral wall.

In the above fan flow guide structure, the wind supplementing section is a low-pressure and high-flow-speed section.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
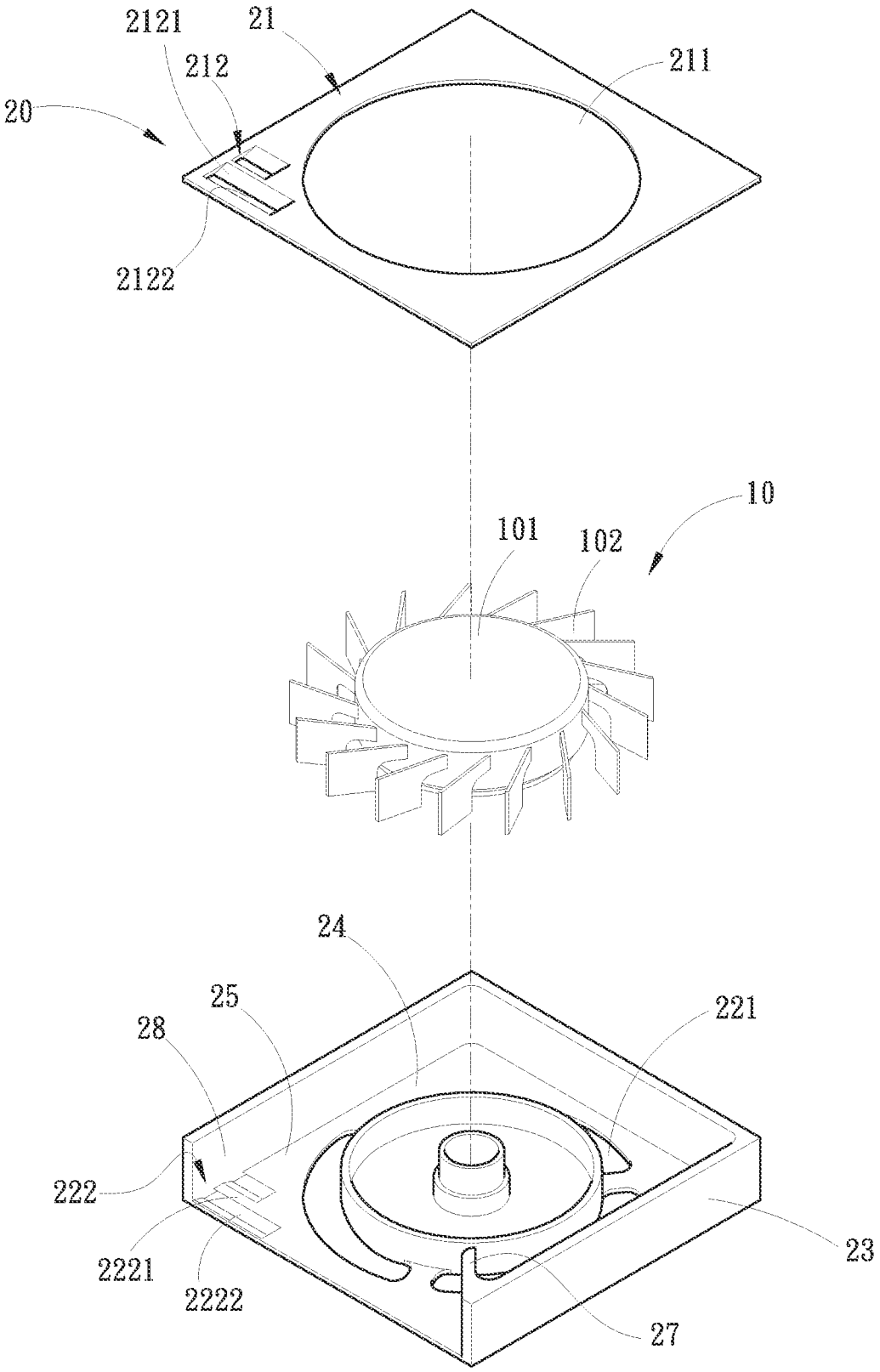
FIG. 1 is a perspective exploded view of the fan flow guide structure of the present invention.
Figure 2:
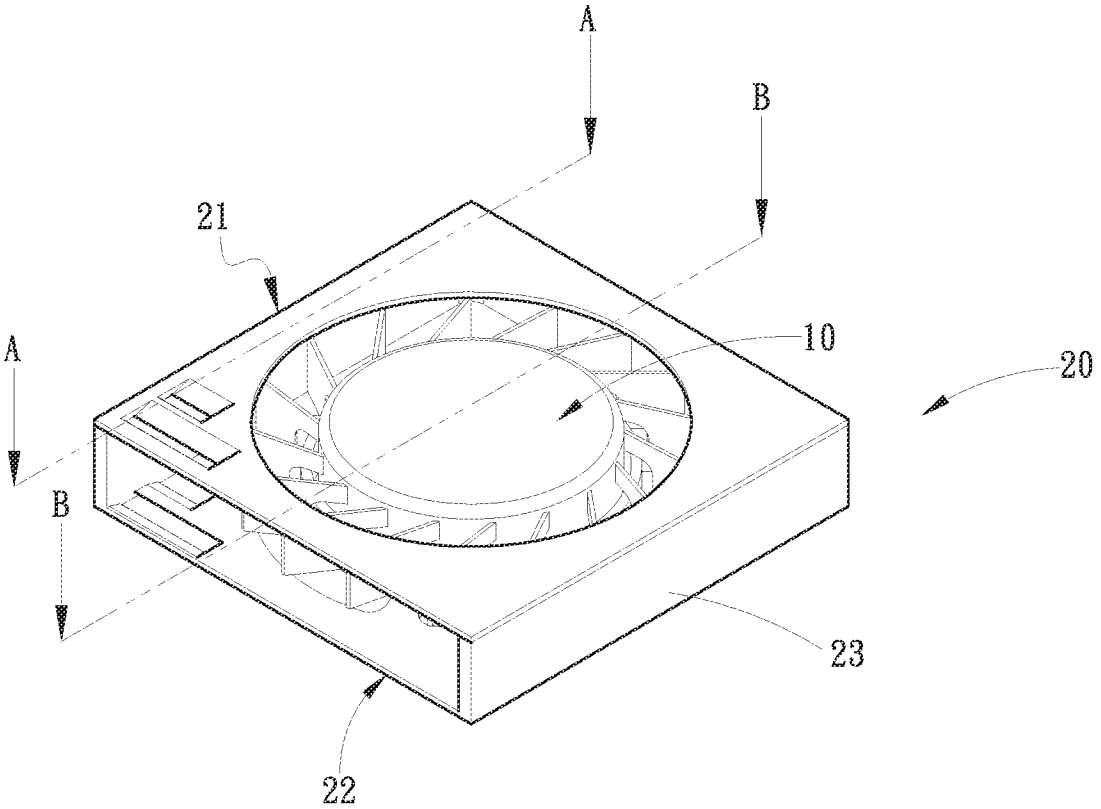
FIG. 2 is a perspective assembled view of the fan flow guide structure of the present invention.

The present invention provides a fan flow guide structure applicable to a centrifugal fan. Please refer to FIGS. 1 and 2. FIG. 1 is a perspective exploded view of the fan flow guide structure of the present invention. FIG. 2 is a perspective assembled view of the fan flow guide structure of the present invention. As shown in the drawings, the fan flow guide structure of the present invention includes a centrifugal fan impeller 10 and a case 20. The centrifugal fan impeller 10 has a hub 101 and multiple blades 102. The case 20 includes an upper cover 21 and a base seat 22 axially connected with the upper cover 21. A peripheral wall 23 is formed between the upper cover 21 and a periphery of the base seat 22. A lateral wind outlet 26 is formed on the periphery wall 23. As shown in the drawings, the peripheral wall 23 is, but not limited to, extended from the base seat 22 to the upper cover 21. Alternatively, the peripheral wall 23 can extend from the upper cover 21 to the base seat 22 or extend from the upper cover 21 and the base seat 22 to each other.

A fan impeller space 24 and a flow passage 25 are defined between the upper cover 21 and the base seat 23 and the peripheral wall 23. The fan impeller space 24 serves to receive the centrifugal fan impeller 10. As shown in the drawings, the centrifugal fan impeller 10 is, but not limited to, substantially positioned at the center of the case 20. In a modified embodiment, the centrifugal fan impeller 10 is positioned in a position deviated from the center of the case 20. The upper cover 21 is formed with an upper wind inlet 211. The base seat 22 is formed with a lower wind inlet 221. The upper wind inlet 211 and the lower wind inlet 221 are in communication with the fan impeller space 24.

The flow passage 25 is in communication with the fan impeller space 24 and the lateral wind outlet 26. In addition, a tongue section 27 is disposed in the flow passage 25 in adjacency (connection) to the lateral wind outlet 26. A wind supplementing section 28 is defined opposite to the tongue section 27 in adjacency (connection) to the lateral wind outlet 26. As shown in the drawings, the tongue section 27 and the wind supplementing section 28 are respectively positioned on left and right sides of the lateral wind outlet 26 in adjacency to the lateral wind outlet 26. The tongue section 27 protrudes from the peripheral wall 23. The wind supplementing section 28 is a low-pressure and high-flow-speed section.

Moreover, in this embodiment, an upper intake gill section 212 is disposed on the upper cover 21 corresponding to the wind supplementing section 28. A lower intake gill section 222 is disposed on the base seat 22 corresponding to the wind supplementing section 28 opposite to the upper intake gill section 212. The upper and lower intake gill sections 212, 222 are, but not limited to, in communication with the wind supplementing section 28. In a modified embodiment, only the upper cover 21 is formed with the upper intake gill section 212 or only the base seat 22 is formed with the lower intake gill section 222. Alternatively, a lateral intake gill section (not shown) is disposed on the peripheral wall in the wind supplementing section 28.

Figure 3:
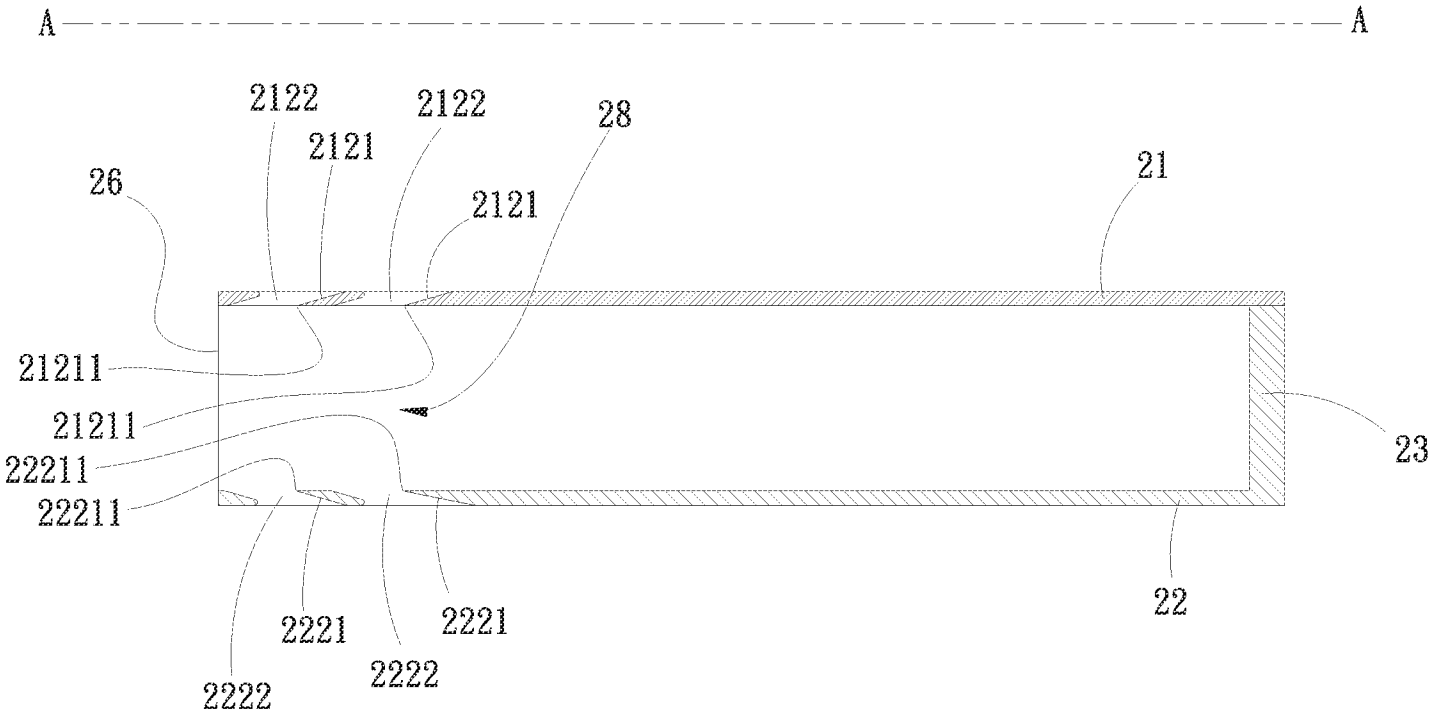
FIG. 3 is a sectional view taken along line A-A of FIG. 2.

Please now refer to FIG. 3, which is a sectional view taken along line A-A of FIG. 2. Also referring to FIGS. 1 and 2, the upper intake gill section 212 includes at least one first guide vane 2121 and at least one first flow guide hole 2122. As shown in the drawing, there are two first guide vanes 2121 and two first flow guide holes 2122. The first guide vanes 2121 obliquely extend from the upper cover 21 to the wind supplementing section 28. Each first guide vane 2121 has a first free end 21211 directed to the lateral wind outlet 26. The first flow guide holes 2122 are in adjacency to the first guide vanes 2121 and directed to the lateral wind outlet 26. The first flow guide holes 2122 obliquely pass through the upper cover 21 in communication with the wind supplementing section 28. The lower intake gill section 222 includes at least one second guide vane 2221 and at least one second flow guide hole 2222. As shown in the drawing, there are two second guide vanes 2221 and two second flow guide holes 2222. The second guide vanes 2221 obliquely extend from the base seat 22 to the wind supplementing section 28. Each second guide vane 2221 has a second free end 22211 directed to the lateral wind outlet 26. The at least one second flow guide holes 2222 are in adjacency to the second guide vanes 2221 and directed to the lateral wind outlet 26. The second flow guide holes 2222 obliquely pass through the base seat 22 in communication with the wind supplementing section 28.

Figure 4A:
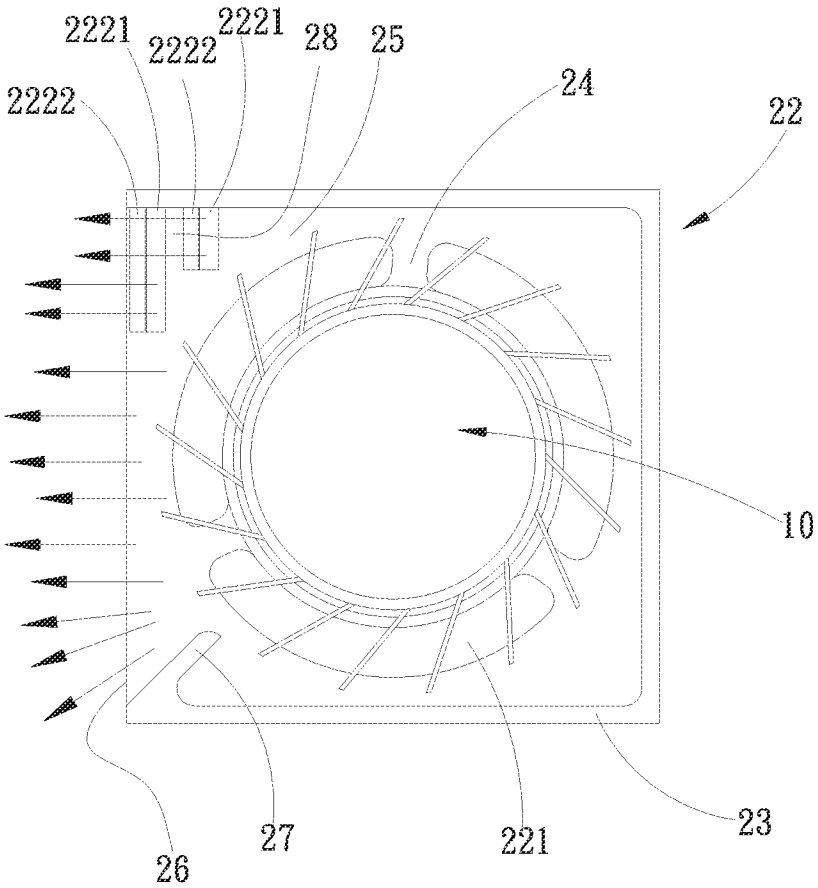
FIGS. 4A to 4C are operational views of the fan flow guide structure of the present invention.
Figure 4B:
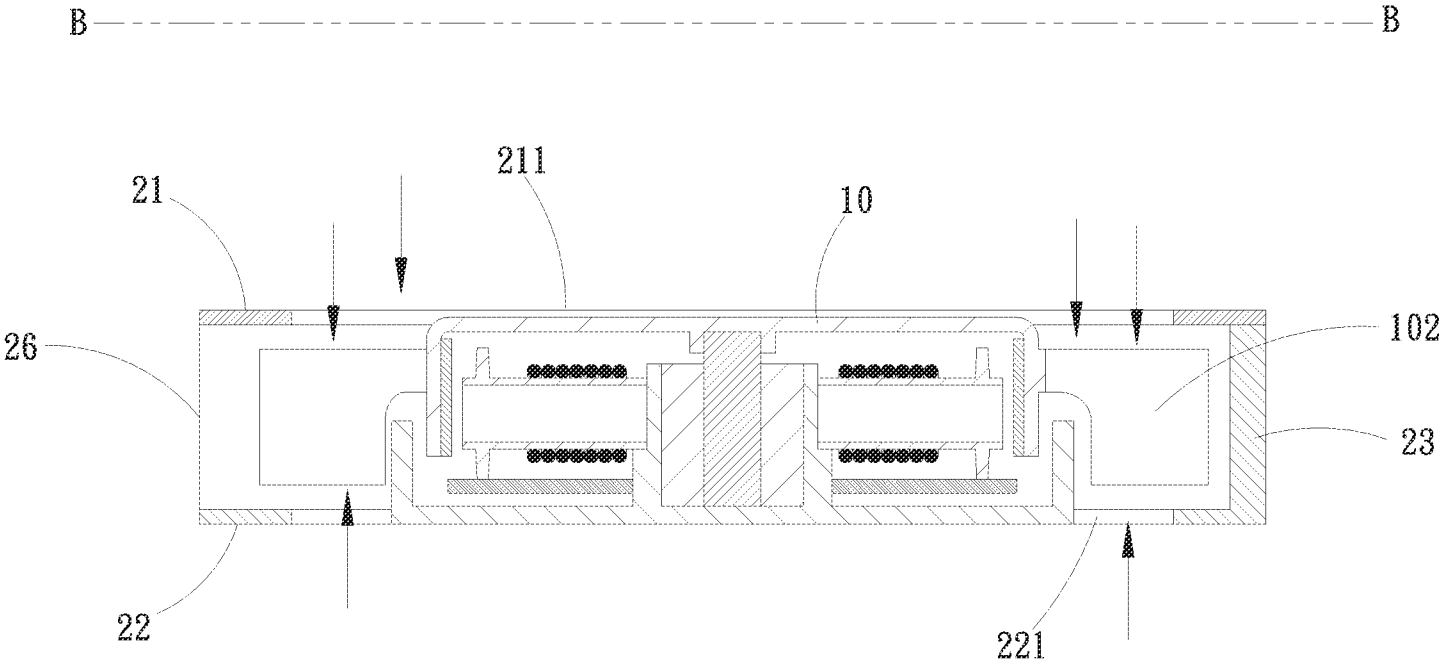
Figure 4C:
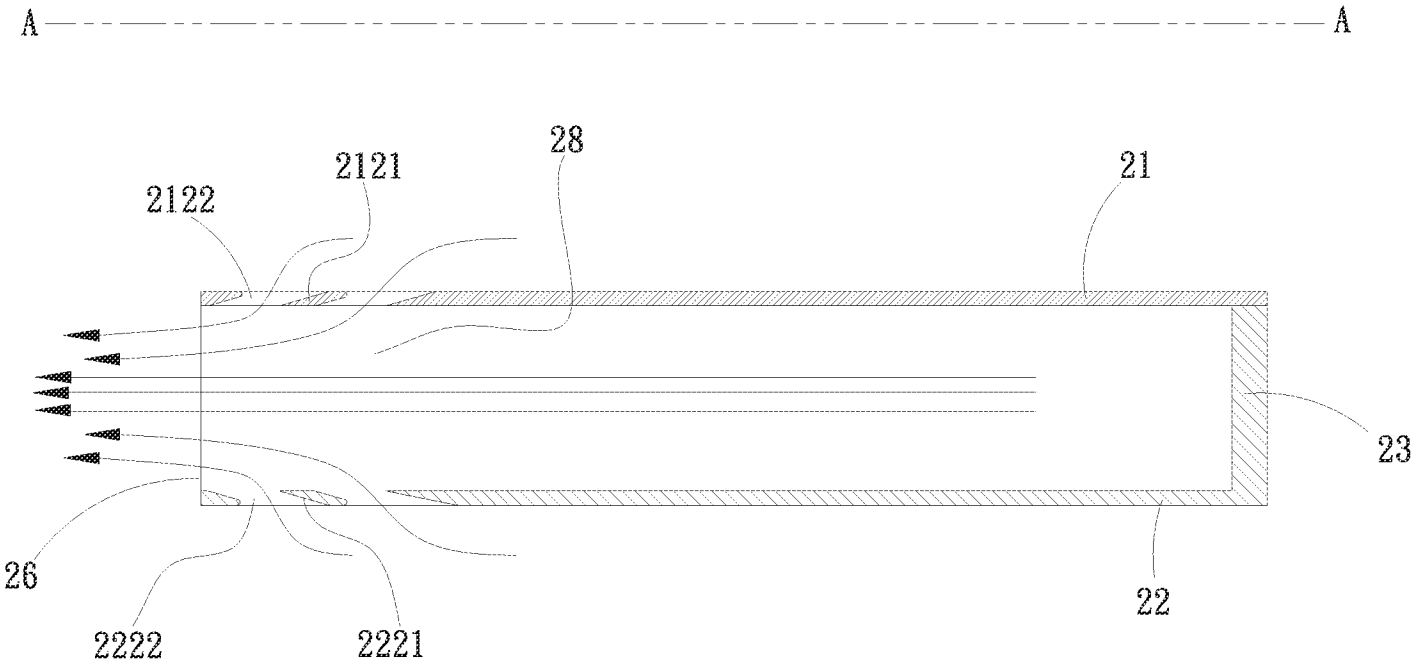

Please now refer to FIGS. 4A to 4C, which are operational views of the fan flow guide structure of the present invention. In FIG. 4A, the upper cover is removed for easy illustration of the airflow direction. FIG. 4B is a sectional view taken along line B-B of FIG. 2. FIG. 4C is a sectional view taken along line A-A of FIG. 2. As shown in the drawings, after the centrifugal fan impeller 10 starts to operate, the airflow is taken in through the upper wind inlet 211 of the upper cover 21 and the lower wind inlet 221 of the base seat 22 to flow toward the lateral wind outlet 26. In addition, the supplementing air outside the case 20 is also guided from the upper intake gill section 212 and the lower intake gill section 222 into the wind supplementing section 28 to flow out from the lateral wind outlet 26. The upper and lower intake gill sections 212, 222 have an inclination direction identical to the airflow direction. That is, the first guide vanes 2121 and the first flow guide holes 2122 and the second guide vanes 2221 and the second flow guide holes 2222 are inclined and directed to the lateral wind outlet 26. Therefore, the supplementing air can be successfully guided through the first and second flow guide holes 2122, 2222 into the wind supplementing section 28 to then flow out from the lateral wind outlet 26. Accordingly, the low pressure of the wind supplementing section 28 is supplemented to enhance the total flow amount of the fan.

Figure 5:
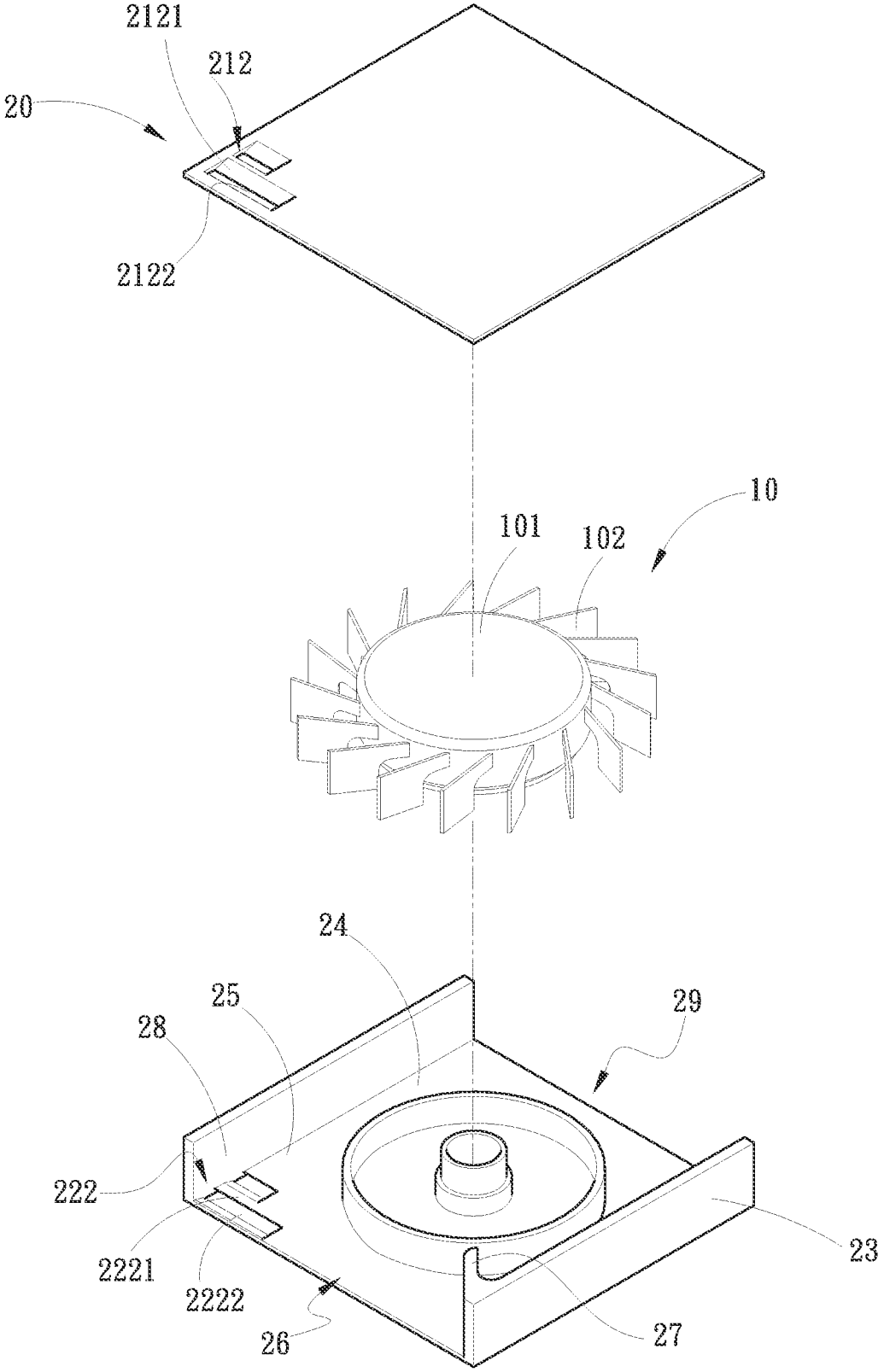
FIG. 5 is a perspective exploded view of another embodiment of the fan flow guide structure of the present invention, which has a different wind inlet.
Figure 6A:
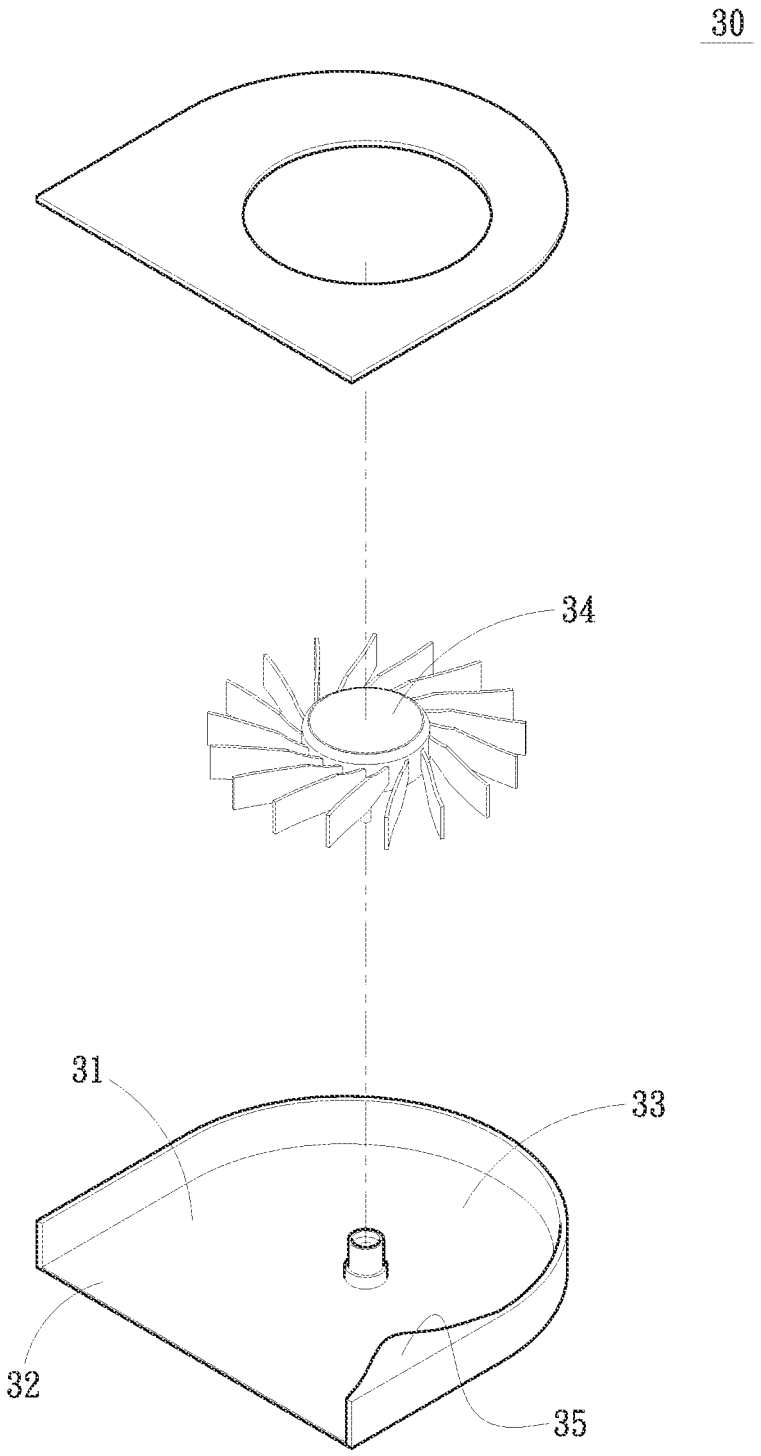
PRIOR ART Fig. 6A
FIG. 6A is a perspective exploded view showing the structure of a conventional centrifugal fan.
Figure 6B:
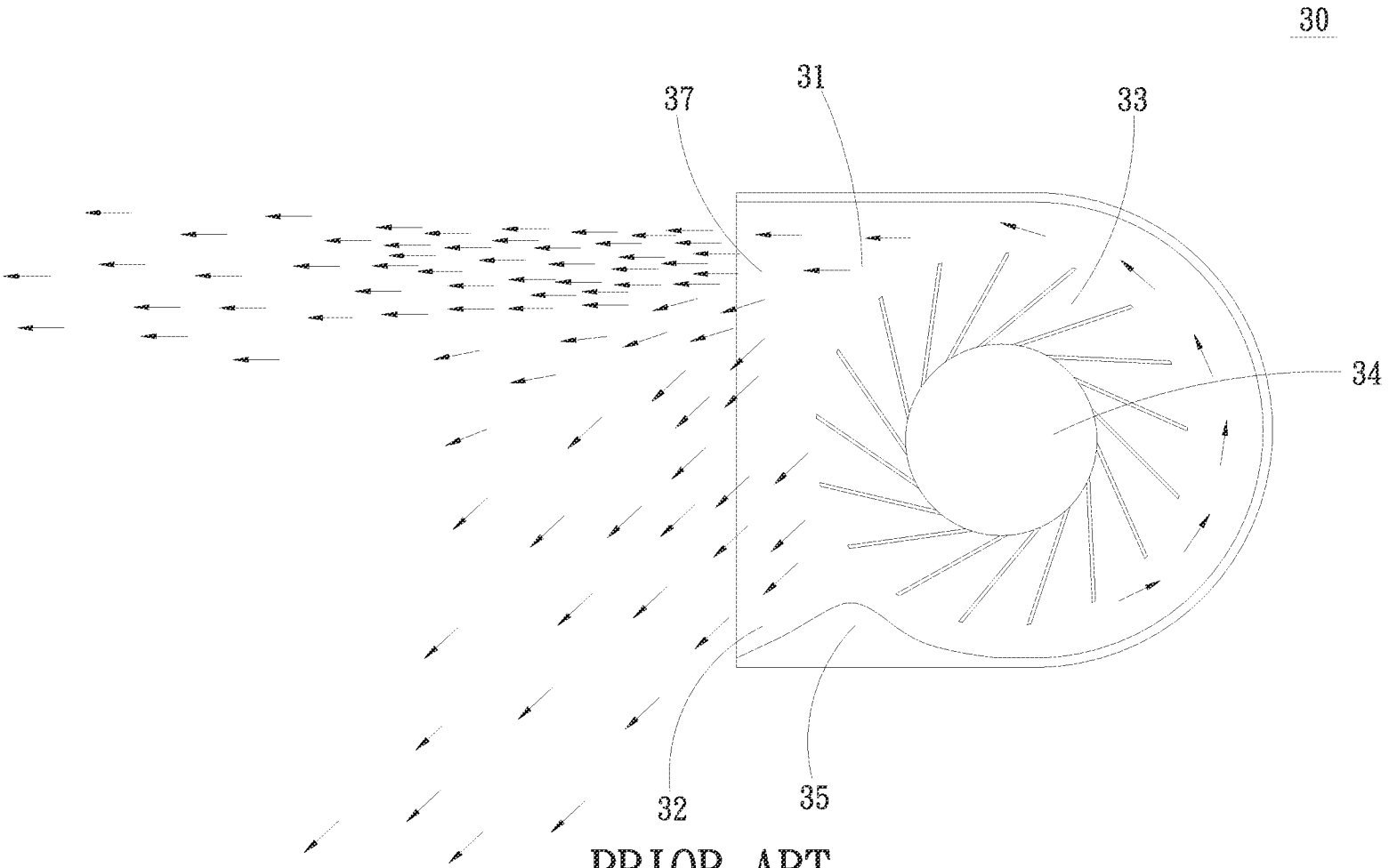
PRIOR ART Fig. 6B
FIG. 6B is a top view showing the flow field of the conventional centrifugal fan.

Please now refer to FIG. 5, which is a perspective exploded view of another embodiment of the fan flow guide structure of the present invention, which has a different wind inlet. In the above embodiment, the upper cover 21 is formed with the upper wind inlet 211 and the base seat 22 is formed with the lower wind inlet 221 (as shown in FIGS. 1, 2 and 4B). However, this is not limited. As shown in FIG. 5, in another embodiment of the present invention, the upper cover 21 and the base seat 22 are free from any wind inlet. Instead, a lateral wind inlet 29 is disposed on the peripheral wall 23 of the case 20. The lateral wind inlet 29 is in communication with the fan impeller space 24. In this embodiment, the lateral wind inlet 29 is, but not limited to, positioned opposite to the lateral wind outlet 26. Alternatively, the lateral wind inlet 29 and the lateral wind outlet 26 can be such positioned as to contain an angle of 90 degrees.

According to the arrangement of the present invention, the fan flow guide structure of the present invention can enhance the fan flow amount in the same fan capacity.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A fan flow guide structure comprising:

a centrifugal fan impeller; and a case, the case including an upper cover and a base seat connected with the upper cover, a peripheral wall being formed between the upper cover and the base seat, a lateral wind outlet being formed in the peripheral wall, the upper cover presenting a lower surface and the base seat presenting an upper surface facing the lower surface of the upper cover, a fan impeller space and a flow passage being defined between the lower surface of the upper cover and the upper surface of the base seat and an inner surface of the peripheral wall, the fan impeller space serving to receive the centrifugal fan impeller, the flow passage being in communication with the fan impeller space and the lateral wind outlet, a tongue section being disposed in the flow passage in adjacency to the lateral wind outlet, a wind supplementing section being defined opposite to the tongue section in adjacency to the lateral wind outlet, an upper intake gill section being disposed on the upper cover corresponding to the wind supplementing section in communication with the wind supplementing section, the upper intake gill section including at least one first guide vane and at least one first flow guide hole, the at least one first guide vane obliquely extending from an exterior surface of the upper cover to the wind supplementing section, the at least one first guide vane having a first free end directed toward the lateral wind outlet and not protruded into the flow passage, the at least one first flow guide hole being in adjacency to the at least one first guide vane and directed toward the lateral wind outlet, and the at least one first flow guide hole obliquely passing through the upper cover in communication with the wind supplementing section.

2. The fan flow guide structure as claimed in claim 1, wherein a lower intake gill section is disposed on the base seat corresponding to the wind supplementing section, the lower intake gill section being in communication with the wind supplementing section.

3. The fan flow guide structure as claimed in claim 2, wherein the lower intake gill section includes at least one second guide vane and at least one second flow guide hole, the at least one second guide vane obliquely extending from a lower surface of the base seat to the wind supplementing section, the at least one second guide vane having a second free end directed toward the lateral wind outlet, the at least one second flow guide hole being in adjacency to the at least one second guide vane and directed toward the lateral wind outlet, the at least one second flow guide hole obliquely passing through the base seat in communication with the wind supplementing section.

4. The fan flow guide structure as claimed in claim 2, wherein the lower intake gill section is opposite to the upper intake gill section of the upper cover.

5. The fan flow guide structure as claimed in claim 1, wherein the upper cover has an upper wind inlet and the base seat has a lower wind inlet, the upper wind inlet and the lower wind inlet being in communication with the fan impeller space.

6. The fan flow guide structure as claimed in claim 1, wherein the case has a lateral wind inlet formed on the peripheral wall in communication with the fan impeller space.

7. The fan flow guide structure as claimed in claim 1, wherein the tongue section protrudes from the peripheral wall.

8. The fan flow guide structure as claimed in claim 1, wherein the wind supplementing section is a low-pressure and high-flow-speed section.

* * * * *